US005221011A

United States Patent [19]

Coto

[11] Patent Number: 5,221,011

[45] Date of Patent: Jun. 22, 1993

[54] NAPKIN HOLDER

[76] Inventor: Julio C. Coto, 851 E. 2nd Ave., Hialeah, Fla. 33010

[21] Appl. No.: 716,636

[22] Filed: Jun. 17, 1991

[51] Int. Cl.[5] ..... A47F 7/00

[52] U.S. Cl. ..... 211/51; 211/43

[58] Field of Search ..... 211/51, 43, 59.3, 175, 211/120

[56] References Cited

U.S. PATENT DOCUMENTS

| | | | |
|---|---|---|---|
| 14,279 | 4/1917 | Back | 211/51 |
| 784,027 | 3/1905 | Borstad et al. | 211/51 |
| 1,674,359 | 6/1928 | Frey | 211/51 |
| 1,843,692 | 2/1932 | McDonald | 211/51 |
| 2,545,844 | 3/1951 | Cougias | 211/51 X |
| 2,603,357 | 7/1952 | Zakos | 211/51 X |
| 3,800,958 | 4/1974 | Dorn | 211/51 |

*Primary Examiner*—Alvin C. Chin-Shue
*Assistant Examiner*—Sarah A. Lechok
*Attorney, Agent, or Firm*—Rosenman & Colin

[57] ABSTRACT

A napkin holder includes a base, a pair of spaced-apart posts extending along respective axes, a pair of pivot arms,both mounted for pivoting movement in one circumferential direction about the axes to an open loading position, and both pivotable in an opposite circumferential direction about the axes to a closed position, and a spring for constantly urging the arms to the closed position to firmly and uniformly hold the napkins in an upright dispensing condition.

17 Claims, 5 Drawing Sheets

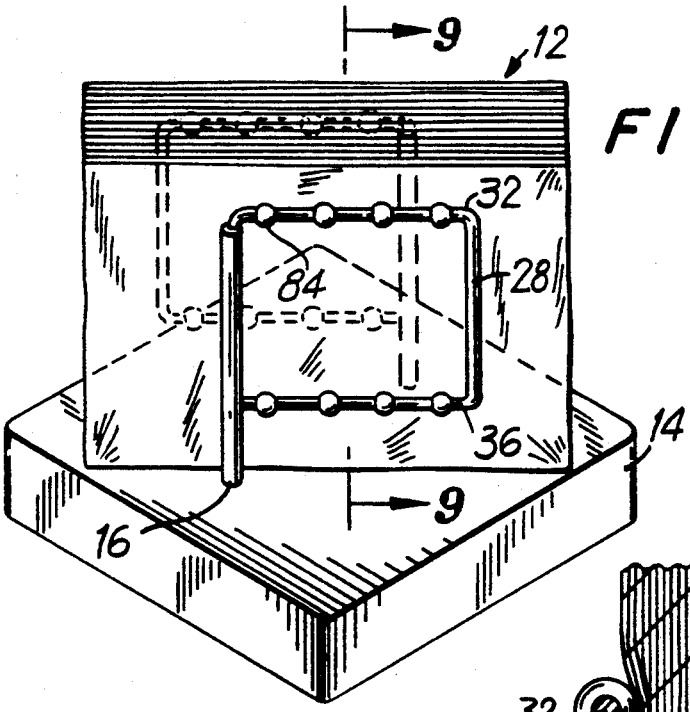
FIG. 8
FIG. 9
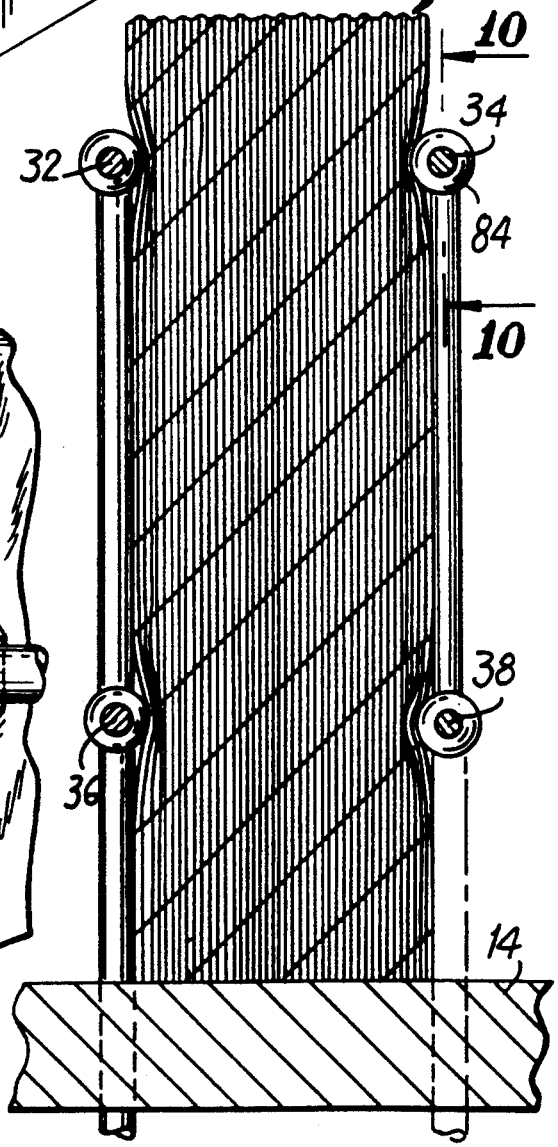
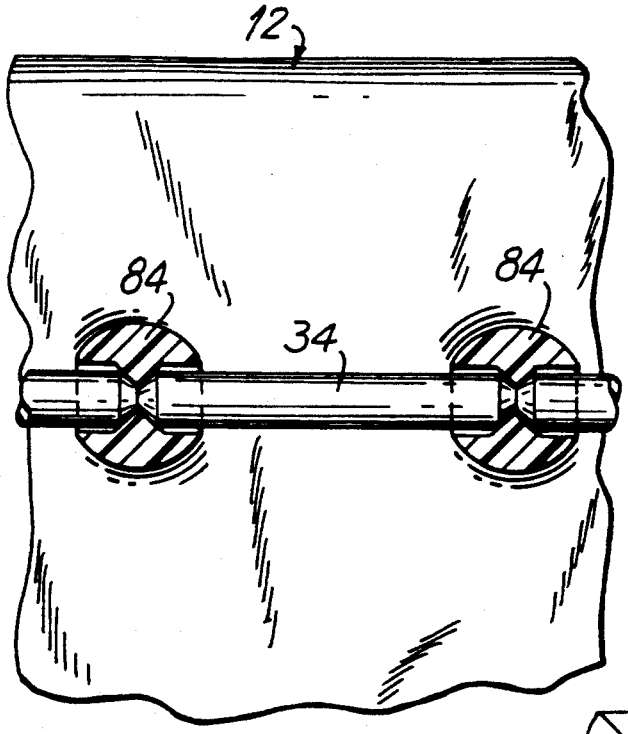
FIG. 10

NAPKIN HOLDER

BACKGROUND OF THE INVENTION

1. Field Of the Invention

This invention generally relates to a holder for sheet materials to be dispensed and, more particularly, to a napkin holder.

2. Description of Related Art

It is known to hold a stack of books, files and like articles between end supports which are linearly movable toward and away from each other. The end supports may be assisted in their linear movement by a spring which constantly urges the end supports together. See, for example, U.S. Pat. Nos. 945,877; 1,237,101; 2,911,103 and 3,800,958.

Although the known article holders are generally satisfactory for their intended purpose, they have not proven to be altogether desirable or practical, especially in the case of napkin holders. Napkins, as is well known, are limp sheet materials which are not self-standing when positioned on edge in an upright dispensing condition in which each napkin lies in a vertical plane generally perpendicular to a horizontal countertop or like supporting surface. Hence, napkins require a great deal of support to maintain the aforementioned dispensing condition, and are typically held in box-like containers having an access opening, wire cages, or, as shown, for example, in U.S. Pat. No. 4,874,099, are held between plate-shaped end supports linearly movable relative to each other. Experience has shown, however, that the known napkin holders are not easily loaded with napkins,not uniformly supported in the upright dispensing condition, and often not easily individually withdrawn from a stack without being torn due to the high coefficient of friction between individual napkins and the plate-shaped end supports.

SUMMARY OF THE INVENTION

1. Objects of the Invention

It is a general object of this invention to advance the state of the art of article holders, particularly napkin holders.

It is another object of this invention to easily load a napkin holder.

Another object of this invention is to uniformly support napkins, no matter how many are present, in a napkin holder.

A further object of this invention is to allow individual napkins to be easily withdrawn from a napkin holder without being torn.

2. Features of the Invention

In keeping with these objects, and others which will become apparent hereinafter, one feature of this invention resides, briefly stated, in a holder for sheet materials, particularly napkins, to be dispensed, comprising a base and a pair of upright posts mounted on the base in a spaced-apart relationship, and extending along respective axes. A pair of pivot arms is mounted on the base for pivoting movement in one circumferential direction about the axes to an open position in which the pivot arms are spaced apart and bound a space for receiving the sheet materials. The arms also pivot in an opposite circumferential direction about the axes to a closed position in which the pivot arms engage the sheet materials. Means are operatively connected to the pivot arms, for constantly urging the arms to the closed position for firmly and uniformly holding the sheet materials in an upright dispensing condition.

In a preferred embodiment, each upright post is a hollow tube, and each pivot arm includes a first rod mounted in, and extending axially through, a respective tube, a second axially-extending rod parallel to the first rod, a third upper rod extending transversely between the first and second rods, and a fourth transversely-extending rod spaced apart, and parallel to, the third rod.

Anti-friction means, e.g. a set of rollers or balls, or slippery coating, is provided on the pivot arms to facilitate withdrawal of individual sheet materials. This prevents tearing of the sheet materials.

The pivot arms are jointly movable, and are interconnected by a link having opposite ends pivotably connected to a respective rod of each arm. The urging means is a coil spring operatively connected between the base and the link.

In another embodiment, a pair of upper arm assemblies are mounted above the pivot arms,and are constantly biased toward each other to pinch a stack of sheet materials stored between the arms. A pair of lower arm assemblies are mounted below the pivot arms, and are also constantly biased toward each other to pinch the stack. This upper and lower pinching of the stack maintains the same in an upright, esthetic, dispensing condition.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 8 is a perspective view of a third embodiment of a holder according to this invention after being loaded with the sheet materials.

FIG. 9 is an enlarged, broken-away, sectional view taken on line 9—9 of FIG. 8;

FIG. 10 is an enlarged, sectional view taken on line 10—10 of FIG. 9.

DETAILED DESCRIPTION OF THE PREFERRED EMBODIMENTS

Figure 1:
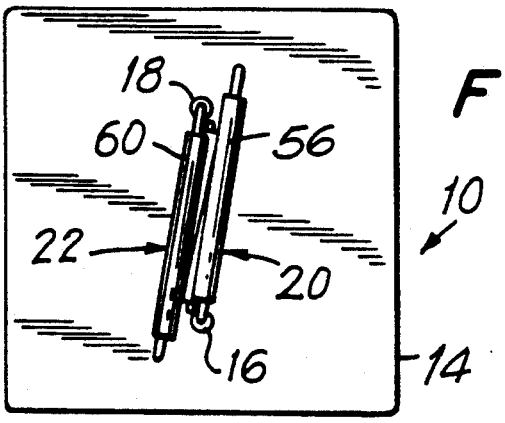
FIG. 1 is a top plan view of a first embodiment of a holder according to this invention prior to being loaded with sheet materials.
Figure 2:
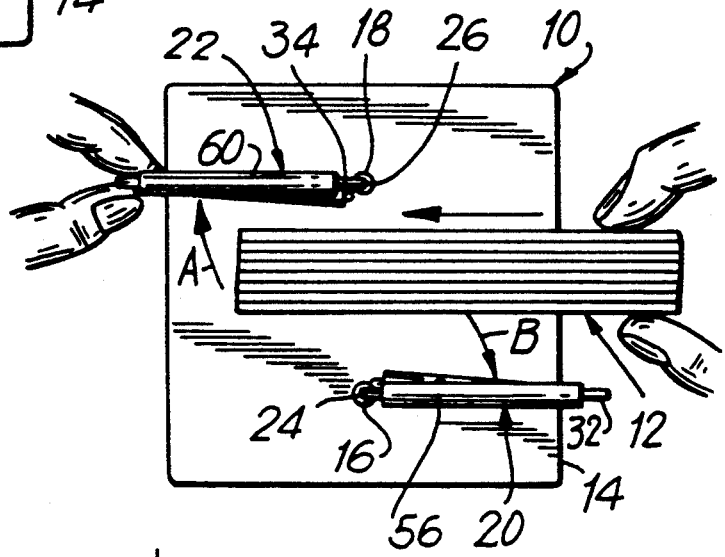
FIG. 2 is a view analogous to FIG. 1 during the loading of the sheet materials.
Figure 3:
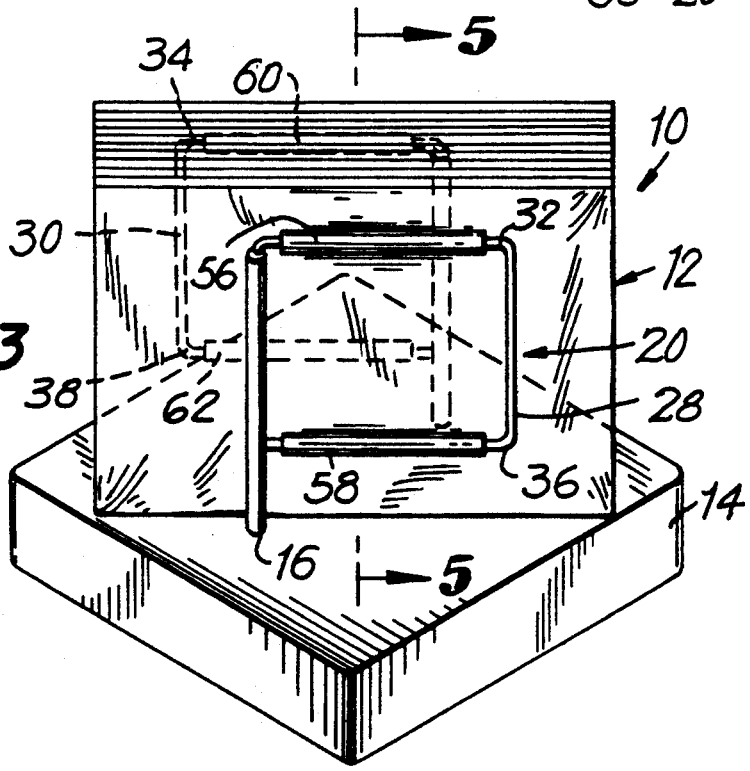
FIG. 3 is a perspective view of the first embodiment after being loaded with the sheet materials.

Referring now to the drawings, FIGS. 1-5 depict a first embodiment of a holder 10 for sheet materials, for example, a stack of napkins 12 or analogous limp sheet materials incapable of self-standing when positioned on edge in an upright dispensing condition. The holder 10 includes a base 14 for resting on a horizontal support surface, and a pair of upright posts 16, 18 stationarily mounted on, and vertically extending through, the base in a spaced-apart relation. The stationary posts 16, 18 are elongated, hollow tubes, each extending along an upright axis.

A pair of pivot arms 20, 22 are mounted on the base for pivoting movement about the axes of the posts. Arms 20, 22 respectively have first axially-extending inner rods 24, 26 mounted in, and extending through, the hollow posts 16, 18; second axially-extending outer rods 28, 30 spaced apart and extending generally parallel to the first rods 24, 26; third upper rods 32, 34 extending in a transverse direction between the first and second rods; and fourth transversely-extending lower rods 36, 38 spaced apart and extending generally parallel to the third rods. Rods 24, 28, 32, 36 are integrally formed from a single piece of rod-like material, e.g. metal or plastic, and are bent to form a generally flag-like configuration for the arm 20. Similarly, rods 26, 30, 34, 38 are integrally formed from a single piece of rod-like material, e.g. metal or plastic, and are bent to form a generally flag-like configuration for the arm 22.

Figure 4:
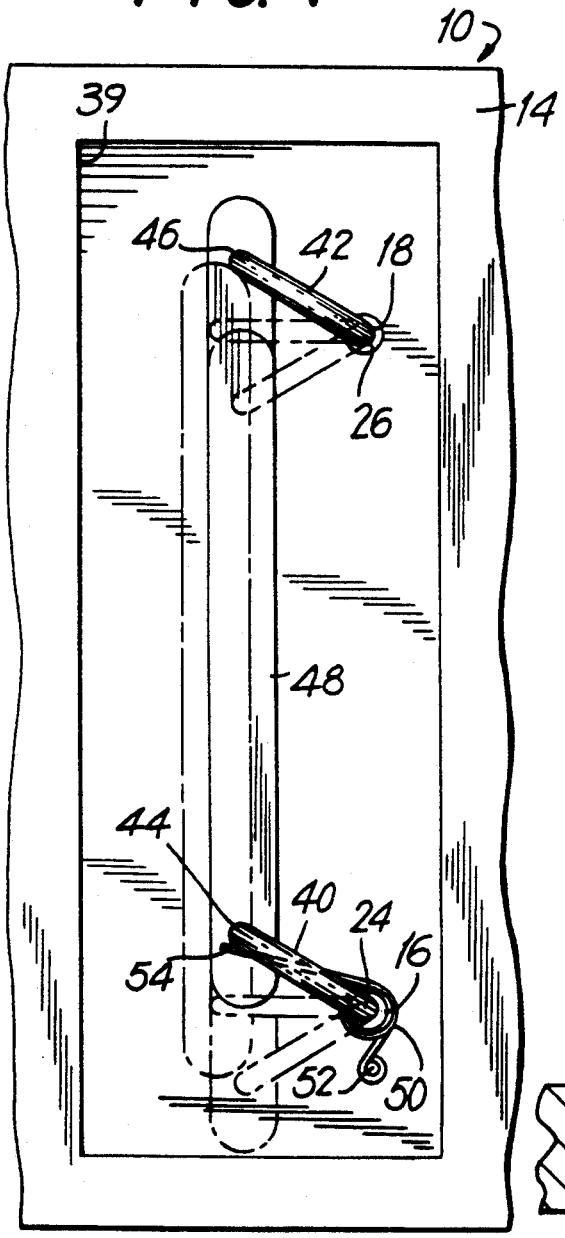
FIG. 4 is an enlarged, broken-away, bottom plan view of the first embodiment.
Figure 5:
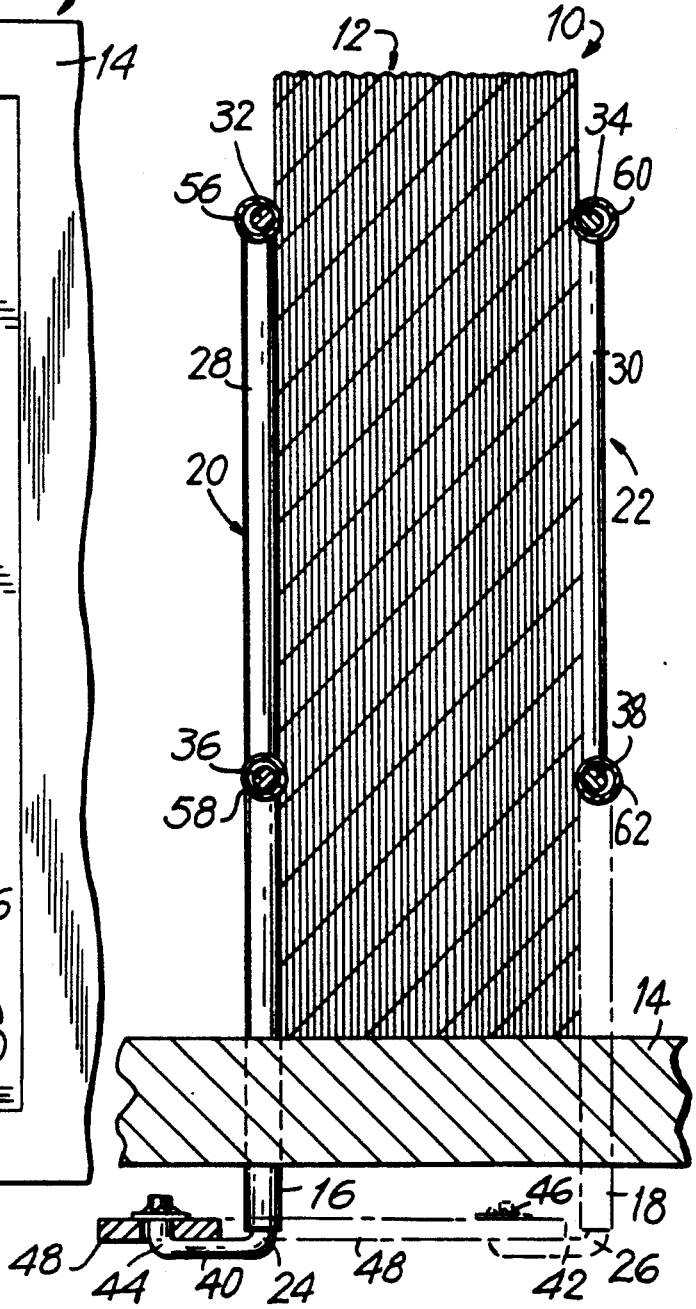
FIG. 5 is an enlarged, broken-away, sectional view taken on line 5—5 of FIG. 3.

As best shown in FIGS. 4 and 5, the first inner rods 24, 26 extend to the underside of the base 14 which is formed with a clearance channel 39. The first rods 24, 26 have bent extensions 40, 42 extending radially of their respective axes and are bent axially again to form shaft portions 44, 46 which are pivotably connected to opposite end regions of an interconnecting link 48. Link 48, extension portions 40, 42 and the base 14 together constitute a four-bar parallelogram linkage. A biasing spring, such as coil spring 50, has one end 52 anchored to the base 14, and an opposite end 54 constantly biasing against and pushing the shaft portion 44, and pushing the entire linkage to the solid line position shown in FIG. 4.

Returning to FIG. 1, prior to being loaded with the sheet materials 12, the spring 50 urges the arms 20, 22 to the illustrated side-by-side position in which each post 16, 18 serves as a stop. The arms 20, 22 are slightly offset as considered along the transverse direction, thereby allowing a user to grasp an outer rod 28, 30 of a respective arm. To load the holder, the user pivots an arm, e.g. arm 22, in the circumferential direction of the arrow A. Arm 20 participates in this joint movement due to its operative connection with arm 22 via the interconnecting link 48. Arm 20 follows in the direction of the arrow B. As shown in the open position of FIG. 2, the arms are spaced apart and bound a space for receiving a stack of sheet materials 12.

Once loaded, arm 22 is released. The spring 50 turns both arms 20, 22 in the opposite circumferential direction to the closed position of FIG. 3 wherein the arms engage opposite ends of the stack and, with the aid of the stored tension in the spring 50, uniformly and firmly hold the sheet materials under pressure in the illustrated upright dispensing condition depicted in FIG. 3.

To facilitate withdrawal of the individual sheet materials from the stack without tearing the withdrawn sheet materials, anti-friction means, e.g. cylindrical rollers 56, 58, are mounted for rolling movement on upper and lower rods 32, 36,respectively, of arm 20, and cylindrical rollers 60, 62 are mounted for rolling movement on upper and lower rods 34, 38 of arm 22. An anti-friction slippery-type coating, e.g. made of plastic material, could also be applied over the upper and lower rods of the arms to reduce sliding friction during withdrawal.

Figure 6:
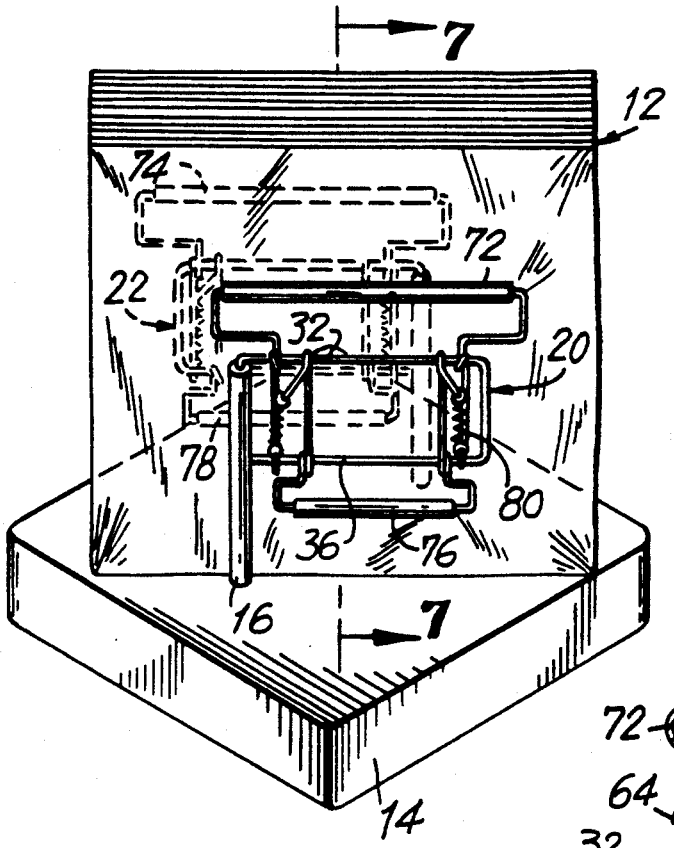
FIG. 6 is a perspective view of a second embodiment of a holder according to this invention after being loaded with the sheet materials.

Turning now to the second embodiment of FIGS. 6 and 7, the second embodiment is essentially the same as the first, except for the addition of a pair of upper arm assemblies 64, 66 mounted above the arms 20, 22, as well as a pair of lower arm assemblies 68, 70 mounted below the arms 20, 22. Like reference numerals have been used to identify like parts from the first embodiment. Upper arm assemblies 64, 66 include anti-friction cylindrical rollers 72, 74, and lower arm assemblies 68, 70 include anti-friction cylindrical rollers 76, 78. Upper arm assemblies 64, 66 are mounted for pivoting movement toward and away from each other on upper rods 32, 34. Lower arm assemblies 68, 70 are mounted for pivoting movement toward and away from each other on lower rods 36, 38. A pair of springs 80 are mounted on, and spaced apart along, arm 20. Another pair of springs 82 are mounted on, and spaced apart along, arm 22.

Figure 7:
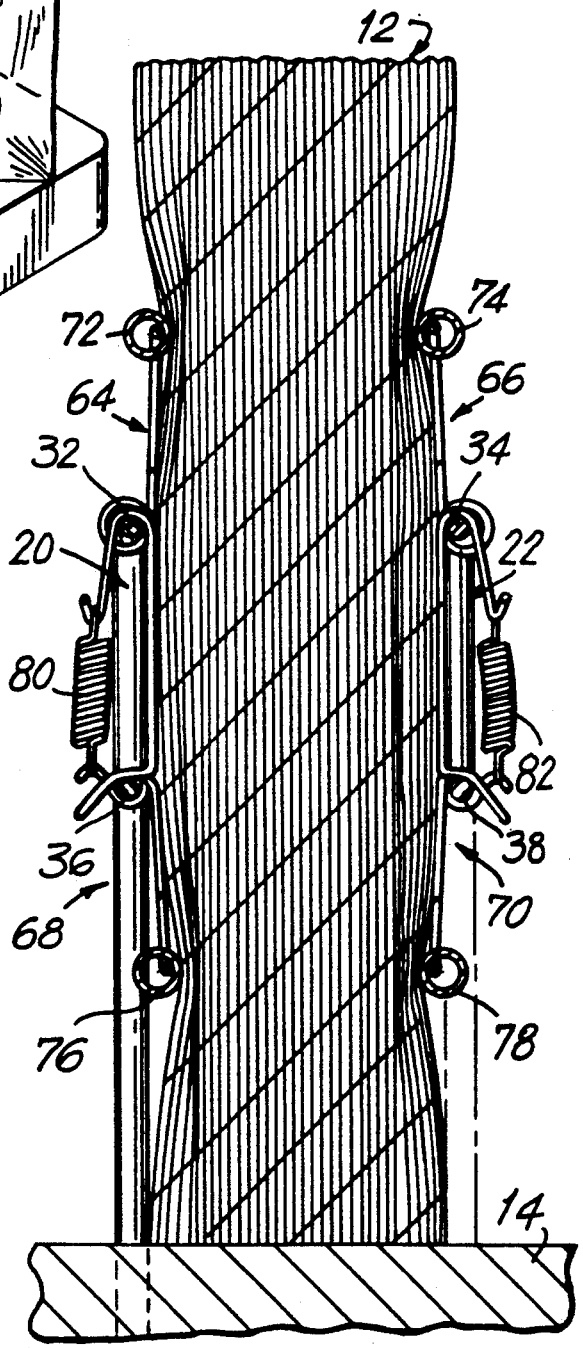
FIG. 7 is an enlarged, broken-away, sectional view taken on line 7—7 of FIG. 6.

As shown in FIG. 7, the spring pairs 80, 82 are operatively connected to the upper and lower arm assemblies to pull the upper arm assemblies 64, 66 toward each other and pinch an upper region of the stack, and to pull the lower arm assemblies 68, 70 toward each other to pinch a lower region of the stack. The upper and lower pinching serve to insure that the stack is more securely and uniformly held in the upright dispensing position without falling over.

Turning now to the third embodiment of FIGS. 8-10, again like reference numerals have been employed to identify like parts. The third embodiment is essentially identical to the first, except that rather than using cylindrical rollers to reduce the effects of friction during withdrawal of individual sheet materials, each upper and lower rod of the arms is provided with a plurality of balls 84 mounted for rolling movement on a respective rod.

Figure 11:
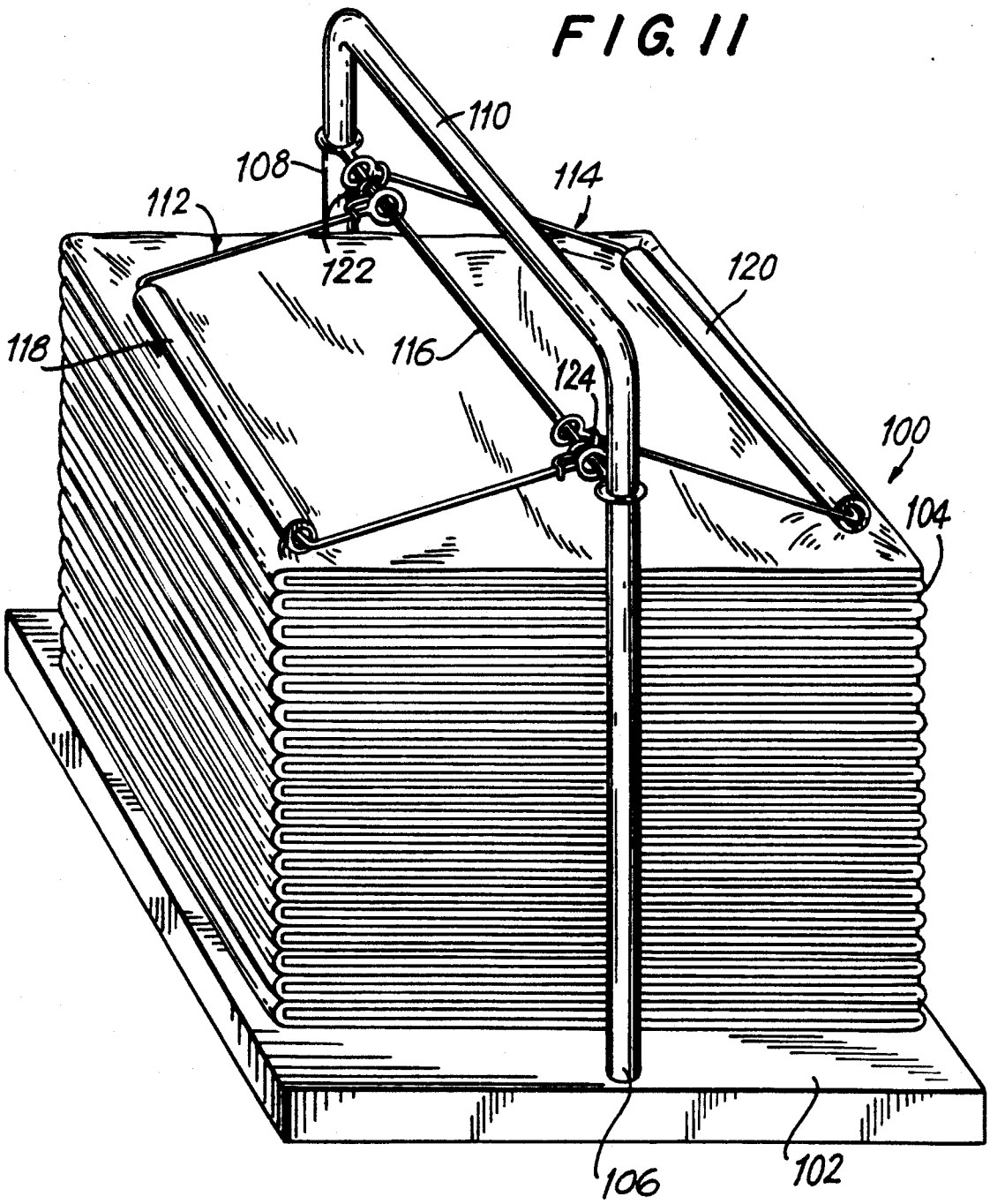
FIG. 11 is a perspective view of a fourth embodiment of a holder according to this invention after being loaded with the sheet materials.

As shown in the fourth embodiment of FIG. 11, a holder 100 comprises a base 102 on which a stack of sheet materials 104 is stacked, one above another, each sheet material lying in a generally horizontal plane. A pair of upright posts 106, 108 are stationarily mounted on the base 102 and extend to an elevation above the stack. A cross-bar 110 serving as a handle extends between, and interconnects, the posts 106, 108. A pair of arm assemblies 112, 114 are pivotably mounted on a lower bar 116 which also extends between, and is connected to, the upright posts 106, 108. Each arm assembly includes a generally rectangularly-shaped rod on which cylindrical rollers 118, 120 are mounted for rolling movement. Each assembly includes a coil spring 122, 124 surrounding the bar 116 and constantly urging each assembly toward the base 102 to effectively clamp the stack 104 between the arm assemblies and the base.

It will be understood that each of the elements described above, or two or more together, also may find a useful application in other types of constructions differing from the types described above.

While the invention has been illustrated and described as embodied in a napkin holder, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A holder for sheet materials to be dispensed, comprising:

(a) a base;

(b) a pair of upright posts mounted on the base in a spaced-apart relationship and extending along respective axes;

(c) a pair of pivot arms mounted on the base for pivoting movement in one circumferential direction about the axes to an open position in which the pivot arms are spaced apart and bound a space for receiving the sheet materials, and in an opposite circumferential direction about the axes to a closed position in which the pivot arms engage the sheet materials; and (d) means operatively connected to the pivot arms, for constantly urging the pivot arms to the closed position for firmly and uniformly holding the sheet materials in an upright dispensing condition.

2. The holder as recited in claim 1, wherein each upright post is a hollow tube, and wherein each pivot arm includes an elongated rod mounted in, and extending through, a respective tube.

3. The holder as recited in claim 1, wherein each upright post is a hollow tube, and wherein each pivot arm includes a first rod mounted in, and extending axially through, a respective tube, a second axially-extending rod spaced apart in mutual parallelism with the first rod, a third rod extending in a transverse direction between the first and second rods, and a fourth transversely-extending rod spaced apart in mutual parallelism with the third rod.

4. The holder as recited in claim 1; and further comprising anti-friction means on the pivot arms to facilitate withdrawal of the sheet materials.

5. The holder as recited in claim 4, wherein the anti-friction means includes at least one roller mounted on each pivot arm for rolling movement.

6. The holder as recited in claim 5, wherein each said one roller is a cylinder.

7. The holder as recited in claim 5, wherein each said one roller includes a plurality of balls.

8. The holder as recited in claim 1; and further comprising means for interconnecting the pivot arms for joint pivoting movement.

9. The holder as recited in claim 8, wherein each pivot arm includes an elongated rod, and wherein the interconnecting means includes a link pivotably connected to a respective rod, and wherein the urging means is a spring operatively coupled between the base and the link.

10. The holder as recited in claim 1; and further comprising a pair of upper arm assemblies and a pair of lower arm assemblies respectively mounted above and below the pivot arms; and means for constantly biasing the upper arm assemblies toward each other, and for constantly biasing the lower arm assemblies toward each other.

11. A holder for sheet materials to be dispensed, comprising:

(a) a base;

(b) a pair of upright posts mounted on the base in a spaced-apart relationship and bounding a space for receiving a stack of sheet materials therebetween, said materials being in contact with said base; and (c) anti-friction means on the arms to facilitate withdrawal of the sheet materials.

12. The holder as recited in claim 11, wherein the anti-friction means includes at least one roller mounted on each upright arm for rolling movement.

13. The holder as recited in claim 12, wherein each said one roller is a cylinder.

14. The holder as recited in claim 12, wherein each said one roller includes a plurality of balls.

15. A holder for sheet materials to be dispensed, comprising:

(a) a base;

(b) an arm mounted above, and spaced from, the base to bound a space for receiving a stack of sheet materials therebetween, said materials being in contact with said base; and (c) anti-friction means on the arm to facilitate withdrawal of the sheet materials.

16. The holder as recited in claim 15, wherein the anti-friction means includes at least one roller mounted on the arm for rolling movement.

17. The holder as recited in claim 16, wherein said one roller includes a plurality of balls.

* * * * *